US006495075B1

(12) United States Patent
Middeljans et al.

(10) Patent No.: US 6,495,075 B1
(45) Date of Patent: Dec. 17, 2002

(54) PROCESS FOR PREPARING POLYKETONE FIBRES

(75) Inventors: Hendrik Middeljans, Dieren (NL); Jannes Veurink, Brummen (NL); Johannes A. Juijn, Velp (NL)

(73) Assignee: Acordis Industrial Fibers BV, Arnhem (NL)

( * ) Notice: Subject to any disclaimer, the term of this patent is extended or adjusted under 35 U.S.C. 154(b) by 0 days.

(21) Appl. No.: 09/582,947

(22) PCT Filed: Feb. 9, 1999

(86) PCT No.: PCT/EP99/00859

§ 371 (c)(1), (2), (4) Date: Jul. 28, 2000

(87) PCT Pub. No.: WO99/41437

PCT Pub. Date: Aug. 19, 1999

(30) Foreign Application Priority Data

Feb. 12, 1998 (NL) ..... 1008280

(51) Int. Cl.[7] ..... D01D 5/084; D01F 1/02; D01F 6/26; D01F 6/30; G01N 11/08

(52) U.S. Cl. ..... 264/40.1; 73/54.09; 264/176.1; 264/211; 264/211.17

(58) Field of Search ..... 264/40.1, 176.1, 264/211, 211.17; 73/54.09

(56) References Cited

U.S. PATENT DOCUMENTS

| | | | | |
|---|---|---|---|---|
| 4,960,808 | A | 10/1990 | Schmitter | |
| 4,992,499 | A | 2/1991 | Syrier et al. | |
| 5,021,496 | A | 6/1991 | Machado et al. | |
| 5,066,701 | A | 11/1991 | George et al. | |
| 5,077,333 | A | 12/1991 | George | |
| 5,115,003 | A | 5/1992 | George | |
| 5,122,565 | A | 6/1992 | George | |
| 5,141,981 | A | 8/1992 | George et al. | |
| 5,229,445 | A | 7/1993 | Syrier et al. | |
| 5,820,806 | A | * 10/1998 | Cloos et al. | 264/203 |

FOREIGN PATENT DOCUMENTS

| | | | |
|---|---|---|---|
| EP | 0 121 965 | A2 | 10/1984 |
| EP | 0 222 454 | A2 | 5/1987 |
| EP | 0 224 304 | A1 | 6/1987 |
| EP | 0 227 135 | A2 | 7/1987 |
| EP | 0 228 733 | A1 | 7/1987 |
| EP | 0 229 408 | A1 | 7/1987 |
| EP | 0 235 865 | A2 | 9/1987 |
| EP | 0 235 866 | A2 | 9/1987 |
| EP | 0 239 145 | A2 | 9/1987 |
| EP | 0 245 893 | A2 | 11/1987 |
| EP | 0 246 674 | A2 | 11/1987 |
| EP | 0 246 683 | A2 | 11/1987 |
| EP | 0 248 483 | A2 | 12/1987 |
| EP | 0 253 416 | A1 | 1/1988 |
| EP | 0 254 343 | A1 | 1/1988 |
| EP | 0 257 663 | A2 | 3/1988 |
| EP | 0 259 914 | A1 | 3/1988 |
| EP | 0 262 745 | A2 | 4/1988 |
| EP | 0 263 564 | A1 | 4/1988 |
| EP | 0 264 159 | A1 | 4/1988 |
| EP | 0 272 728 | A2 | 6/1988 |
| EP | 0 277 695 | A2 | 8/1988 |
| EP | 0 289 077 | A2 | 11/1988 |
| EP | 0 310 171 | A2 | 4/1989 |
| EP | 0 326 223 | A2 | 8/1989 |
| EP | 0 478 088 | A1 | 4/1992 |
| WO | WO 93/14134 | A1 | 7/1993 |
| WO | WO 94/20562 | A1 | 9/1994 |

* cited by examiner

*Primary Examiner*—Leo B. Tentoni
(74) *Attorney, Agent, or Firm*—Oliff & Berridge, PLC

(57) ABSTRACT

The invention pertains to a process for preparing thermoplastic fibres by melt-spinning an alternating co-polymer composed of alkenes and carbon monoxide in which the polymer is heated to a temperature of at least $T_{NF}$+5° C., with $T_{NF}$ being the temperature at which the molten polymer is free of crystallization nuclei, and where the residence time of the polymer at a single temperature or different temperatures above the polymer melting point satisfies:

$$\left[\sum_{n=1}^{\infty} t_n \cdot \exp\left(A + \frac{B}{T_n}\right)\right] \leq 1.$$

wherein $t_n$ is the residence time (in minutes) of the polymer at a temperature $T_n$ (in K, with $T_n > T_m$) and A and B are determined by measuring the viscosity of the polymer at different temperatures and residence times.

13 Claims, No Drawings

PROCESS FOR PREPARING POLYKETONE FIBRES

BACKGROUND OF THE INVENTION

The invention pertains to a process for preparing thermoplastic fibres by melt-spinning an alternating copolymer composed of alkenes and carbon monoxide.

Such a process is known from EP 310 171. This application describes the preparation of melt-spun fibres in a process where the polymer is spun at a temperature of at least $T_m$+20° C., with $T_m$ being the crystalline melting point of the polymer.

It was found that if this known process is used for fibre preparation on a larger scale, a number of problems occur which can be attributed in part to the thermal degradation of the polymer, which degradation occurs when the polymer is heated to a temperature above its melting point. These problems manifest themselves in an unstable spinning performance, with the risk of filamentation, discolouration of the polymer, a wide variation in the properties of the formed fibres or a deterioration of the mechanical properties of the formed fibres. These problems are objectionable when fibres are prepared on an industrial scale, i.e. in a continuous process where a large quantity of the desired product is made per unit of time.

SUMMARY OF THE INVENTION

Surprisingly, it has now been found that these problems do not occur when the polymer is spun at a temperature of at least $T_{NF}$+5° C., preferably $T_{NF}$+10° C., with $T_{NF}$ being the temperature at which the molten polymer is free of persistent crystallisation nuclei, which temperature can be determined with the aid of Differential Scanning Calorimetry, and where the residence time of the polymer at a single temperature or different temperatures above the melting point of the polymer satisfies:

$$\left[\sum_{n=1}^{\infty} t_n \cdot \exp\left(A + \frac{B}{T_n}\right)\right] \leq 1$$

wherein $t_n$ is the residence time (in minutes) of the polymer at a temperature $T_n$ (in K, with $T_n > T_m$, with $T_m$ being the melting point of the polymer) and A and B are determined by measuring the viscosity of the polymer at different temperatures and residence times, as described hereinbelow.

DETAILED DESCRIPTION OF PREFERRED EMBODIMENTS

In this application the term fibres refers to staple fibres as well as short fibres, filaments, and yarns (an assembly of filaments).

The term alternating co-polymers composed of alkenes and carbon monoxide in this application refers to polymers built up from alkene and carbon monoxide units in alternating sequence. This means that in the polymer chain each carbon monoxide unit will have two alkene units as its immediate neighbours, and vice versa.

In the process according to the invention, in the preparation of fibres with properties rendering them pre-eminently suitable for technical application, i.e. fibres of great strength and high modulus, preferably use is made of a polymer where 80–100% of the alkene units is composed of ethylene, more preferably a polymer where 80–100% of the alkene units is composed of ethylene and 20–0% of the alkene units is composed of propylene.

The intrinsic viscosity of the polymer employed generally is in the range of 0.3 to 2.5 dl/g, more particularly 0.5 to 1.90, and preferably 0.8 to 1.85 dl/g. The intrinsic viscosity of the polymer [η] or LVN is the limiting viscosity number at an infinitesimally small concentration of the polymer in m-cresol, with $$[\eta] = \lim_{c \to 0} \eta_{spec}/c = \lim_{c \to 0} (t - t_0)/t_0 \cdot c$$

wherein t=time of outflow of the solution from the capillary, $t_0$=time of outflow of the solvent from the same capillary, and c=concentration of the polymer in m-cresol in g/dl at 25° C.

Such alternating copolymers are well-known. The preparation of these co-polymers is described, int. al., in EP 121965; EP 222454; EP 224304; EP 227135; EP 228733; EP 229408; EP 235865; EP 235866; EP 239145; EP 245893; EP 246674; EP 246683; EP 248483; EP 253416; EP 254343; EP 257663; EP 259914; EP 262745; EP 263564; EP 264159; EP 272728; and EP 277695.

In order to improve the polymer's resistance to thermal degradation, adjuvants counteracting said degradation can be added to the polymer. Examples of such adjuvants are inorganic acid binding compounds such as calcium hydroxyapatite or alumina, polymer stabilisers such as sterically hindered phenols, carbodiimides, epoxy compounds, and phosphites, or combinations thereof.

In the process according to the invention the polymer is spun at a temperature of at least $T_{NF}$+5° C. It was found that when the polymer is not heated to $T_{NF}$, there will still be nuclei in the (liquid) polymer, which on cooling of the polymer may cause very rapid crystallisation. In a spinning process this will lead to an irregular spinning picture, which will give rise to, int. al.

- differences in diameter among filaments in a bundle which is spun in one go,
- differences in diameter in the longitudinal direction of the filaments,
- filamentation during spinning.

Such surface irregularities in the spun fibres will render them less suitable for use in most applications; generally speaking, it is great fibre regularity which is desired there. It has now been found that these irregularities do not occur when the polymer is spun at a temperature of at least $T_{NF}$+5° C.

Preferably, the polymer is spun at a temperature of at least $T_{NF}$+10° C., since at this higher temperature the spinning performance of the polymer will be improved further still.

In general, the polymer is subjected to a number of different treatments during the spinning process, which treatments are not necessarily carried out at the same temperature. Generally speaking, the time during which the polymer is subjected to such a treatment (the residence time) is not the same for every treatment step. For instance, the polymer may be melted and homogenised at a temperature $T_1$ for $t_1$ minutes and then conveyed through a heated pipe ($T_2$, residence time $t_2$), after which, via a spinning pump having a temperature $T_3$ (residence time $t_3$), it may be extruded through a spinneret plate having a temperature $T_4$ (residence time $t_4$).

In order to further reduce the polymer degradation, the process settings preferably are selected such that $$\left[\sum_{n=1}^{\infty} t_n \cdot \exp\left(A + \frac{B}{T_n}\right)\right] \leq 0.75$$

In melt-spinning alternating copolymers composed of alkenes and carbon monoxide use may be made of equipment also known to be used for melt-spinning other thermoplastic polymers. For instance, in the extrusion of the polymer use may be made of a spinneret plate such as is employed in melt-spinning other thermoplastic polymers, such as polyamide-6, polyamide-66, and polyester (polyethylene terephthalate). Such a spinneret plate has a number of capillaries having a diameter of 200 to 2000 $\mu$m and an L/D ratio of 1 to 10.

Highly advantageous results are achieved when next to the spinneret plate a hot tube is mounted which has a temperature below the spinning temperature ($T_{spin}$). Preferably, a hot tube with a temperature between $T_{spin}$−50° C. and $T_{spin}$ is employed.

After spinning the resulting fibres may be wound or processed in some other way, e.g., to make non-wovens.

In order to obtain fibres with properties which render them pre-eminently suitable for technical application, the fibres need to be drawn. It is possible to draw the fibres immediately after they have been spun. Alternatively, the wound fibres can be drawn further in a separate process.

The resulting fibres are pre-eminently suitable for use as reinforcing yam in tyres on account of the favourable combination of high strength and high modulus, adhesion to rubber, and fatigue resistance.

Also, the fibres are highly suitable for reinforcing other rubber articles such as conveyor belts and vee belts. In addition, the fibres are highly suitable for use in technical fabrics, more particularly fabrics which exploit the fibres' very good hydrolytic stability, e.g., fabrics used in paper making.

Measuring Methods $T_{NF}$

The temperature at which the polymer is free of crystallisation nuclei ($T_{NF}$) can be determined as follows:

3–4 mg of polymer are introduced into 10 $\mu$l aluminium cups provided with a few holes in the lid. These cups are put into a Perkin Elmer DSC-7 Robotic system and subjected to the following temperature programme under a nitrogen atmosphere:

heating to $T_{hold}$ at a heating-up rate of 10° C./min, with $T_{hold} \geqq T_m$(the crystalline melting point of the polymer), keeping at a constant temperature of $T_{hold}$ for t minutes, and cooling down to room temperature at a cooling rate of 10° C./min, with $T_{hold}$ being varied from $T_m$ to $T_m$+50 and with there preferably being 1–3 minutes of keeping at a constant temperature.

The cooling curve enables the determination of both the peak temperature of the recrystallisation ($T_{rc}$) and the onset of the recrystallisation ($T_{rco}$). The value of $T_{rc}$ or $T_{rco}$ measured over one and the same period of keeping at a constant temperature is then plotted against $T_{hold}$. On the axis on which $T_{hold}$ is plotted $T_{NF}$ can be read from the point of inflection in the curve found.

Determination of A and B

The parameters A and B of a polymer are determined as follows:

The polymer is melted in a Haake rheometer equipped with a device for determining the apparent melt viscosity of a polymeric melt by measuring the pressure drop in a 40 mm long capillary with a diameter of 2 mm. The rheometer should be set up in such a way that it is possible to keep the polymer at a temperature above $T_m$ (the melting point of the polymer in question) for a particular time ($t_a$). Next, the entrance pressure in the capillary is measured as a function of the temperature in the rheometer.

When the temperature increases, a lowering of the entrance pressure of the capillary is observed until a critical temperature $T_c$ is reached. At this temperature a discontinuity in the pressure curve as a function of the temperature is observed.

The determination is carried out at least three times at different residence times $t_a$. In this way three (or more) combinations of $T_c/t_a$ are produced.

Next, using linear regression, the connection is determined between $1/T_c$ (in K) as the x-value and $\ln(1/t_a)$ ($t_a$ in minutes) as the y-value. The intercept of the line found=A, the coefficient of direction of the line found=B.

The invention will be further elucidated with reference to the following unlimitative examples.

EXAMPLE 1

An alternating copolymer of ethylene/propylene and carbon monoxide with a melting point of 220° C., an intrinsic viscosity [η]=1.50, A=30.2, B=−17000, and $T_{NF}$=240° C. was melted in an extruder equipped with five heating zones. In the extruder the polymer passed through the following temperature/residence time profile: 245° C./1.49 min; 248° C./0.38 min.

The polymer was then passed via a conveying pipe and a spinning pump to the spinning assembly including the spinneret plate. The temperature of the conveying pipe, the spinning pump, and the spinning assembly was 250° C. (=$T_{NF}$+10° C.). The residence time of the polymer at this temperature was 43 sec. The polymer was extruded through the spinneret plate having 36 orifices each with a diameter of 400 $\mu$m, and then through a hot tube of 12 cm and a temperature of 200° C.

This way it proved possible to wind spun product at a rate of 400 m/min. The resulting spun product showed very little variation in filament diameter.

In these process conditions it holds that $$\left[\sum_{n=1}^{\infty} t_n \cdot \exp\left(A + \frac{B}{T_n}\right)\right] = 0.22.$$

EXAMPLE 2

Example 1 was repeated, with the proviso that this time use was made of a 5 cm thick heated spinneret plate having 24 orifices. In the extruder the polymer passed through the following temperature/residence time profile: 245° C./5.50 min. The temperature/residence time profile in the spinning box was 245° C./2.45 min, and in the spinneret plate 270° C./0.30 min.

This way it proved possible to wind spun product at a rate of 400 m/min. The resulting spun product showed very little variation in filament diameter.

In these process conditions it holds that $$\left[\sum_{n=1}^{\infty} t_n \cdot \exp\left(A + \frac{B}{T_n}\right)\right] = 0.68.$$

EXAMPLE 3

Example 2 was repeated, with the proviso that this time the temperature/residence time profile in the spinneret plate was 290° C./0.30 min.

This way it proved possible to wind spun product at a rate of 400 m/min. The resulting spun product showed very little variation in filament diameter.

In these process conditions it holds that $$\left[\sum_{n=1}^{\infty} t_n \cdot \exp\left(A + \frac{B}{T_n}\right)\right] = 0.88.$$

Comparative Example 1

Example 1 was repeated, with the proviso that this time the temperature in all heating zones in the extruder, the conveying pipe, the spinning pump, and the spinning assembly was set at 235° C. (=$T_{NF}$−5° C.). The spun product solidified immediately after leaving the spinning plate and became unmanageable.

Comparative Example 2

Example 1 was repeated, with the proviso that this time the temperature of the conveying pipe, the spinning pump, and the spinning assembly was set at 240° C. (=$T_{NF}$). In these process conditions it holds that $$\left[\sum_{n=1}^{\infty} t_n \cdot \exp\left(A + \frac{B}{T_n}\right)\right] = 0.44.$$

Continuous winding of the spun product at a rate of 400 m/min proved impossible.

EXAMPLE 4

Example 1 was repeated, with the proviso that use was made of a hot tube of 40 cm and a temperature of 250° C. and the temperature both in the extruder and in the spinning box were varied in such a manner that the value of Σ in the aforesaid formula was not only <1, but also >1 (comparison).

The outcome of the experiments is shown in the following table.

| Experiment | A | B | C | D* | E* |
|---|---|---|---|---|---|
| Extrusion temperature in ° C. | 250 | 260 | 270 | 280 | 290 |
| Residence time melt in extruder, min | 1.85 | 1.85 | 1.85 | 1.85 | 1.85 |
| Temperature spinbox in ° C. | 252 | 262 | 272 | 282 | 292 |
| Residence time melt in spinbox, min | 0.83 | 0.83 | 0.83 | 0.83 | 0.83 |
| Aggregate of Σ | 0.3 | 0.5 | 0.9 | 1.6 | 2.8 |

-continued

| Experiment | A | B | C | D* | E* |
|---|---|---|---|---|---|
| Spinning properties | fair | fair | few loose filaments in bundle | winding not possible | winding not possible yellow |

The results listed in the table above clearly show that an Σ-value >1 (Comparative examples D* and E*) will not produce good results.

What is claimed is:

1. Process for preparing thermoplastic fibers by melt-spinning an alternating copolymer composed of alkenes and carbon monoxide, the process comprising: spinning the alternating copolymer at a spinning temperature of at least $T_{NF}$+5° C., with $T_{NF}$ being the temperature at which the alternating copolymer is free of crystallisation nuclei, to form the thermoplastic fibers, wherein a residence time of the alternating copolymer at a single temperature or different temperatures above the melting point of the alternating copolymer satisfies:

$$\sum_{n=1}^{\infty} t_n \cdot \exp\left(A + \frac{B}{T_n}\right) \leq 1$$

wherein $t_n$ is a residence time (in minutes) of the alternating copolymer at a temperature $T_n$ (in K, with $T_n > T_m$, with $T_m$ being the melting point of the alternating copolymer) and A and B are determined by measuring a viscosity of the alternating copolymer at different temperatures and residence times.

2. Process according to claim 1, wherein the alternating copolymer is spun at a temperature of at least $T_{NF}$+10° C.

3. Process according to claim 1, wherein the alkenes of the alternating copolymer contain aklkene units and said alkene units include ethylene.

4. Process according to claim 3, wherein 80–100% of the alkene units, are composed of ethylene.

5. Process according to claim 1, wherein the spinning process includes extruding the alternating copolymer through a spinneret plate, following which the alternating copolymer is extruded through a hot tube having a temperature below the spinning temperature ($T_{spin}$).

6. Process according to claim 5, wherein the temperature of the hot tube is between $T_{spin}$−50° C. and $T_{spin}$.

7. Process according to claim 1, wherein the residence time satisfies:

$$\sum_{n=1}^{\infty} t_n \cdot \exp\left(A + \frac{B}{T_n}\right) \leq 0.75.$$

8. Process according to claim 1, wherein $T_{NF}$ is determined by Differential Scanning Calorimetry.

9. Process according to claim 1, wherein an adjuvant is added to the alternating copolymer.

10. Process according to claim 9, wherein the adjuvant is an inorganic acid binding compound comprised of calcium hydroxyapatite or alumina, a polymer stabilizer comprised of sterically hindered phenols, carbodiimides, epoxy compounds or phosphites, or combinations thereof.

11. Process according to claim 4, wherein 0–20% of the alkene units in the alternating copolymer are composed of propylene.

12. Process according to claim 1, wherein the determination of A and B comprises:

(i) melting the alternating copolymer in a rheometer at a temperature above $T_m$ for a time period in minutes ($t_a$);

(ii) measuring an entrance pressure of a capillary integral to the rheometer and a corresponding temperature at a multiplicity of temperatures for said time period ($t_a$);

(iii) graphing a function of the measured entrance pressures and the corresponding temperatures;

(iv) determining a critical temperature ($T_c$), wherein $T_c$ is the temperature where a discontinuity in the graph of the measured entrance pressures and the corresponding temperatures occurs;

(v) determining three or more critical temperatures for corresponding time periods;

(vi) determining $1/T_c$ (in Kelvin) and $\ln(1/t_a)$, where $t_a$ is in minutes;

(vii) plotting $1/T_c$ as an X value of a line and plotting $\ln(1/t_a)$ as a Y value of the line wherein $T_c$ is from the corresponding $t_a$;

(viii) determining an intercept of the line, said intercept being equal to A; and, (ix) determining a slope of the line, said slope being equal to B.

13. Process according to claim 1, wherein the process further comprises drawing the thermoplastic fibers after the spinning step.

* * * * *

UNITED STATES PATENT AND TRADEMARK OFFICE

CERTIFICATE OF CORRECTION

PATENT NO. : 6,495,075 B1 
DATED : December 17, 2002
INVENTOR(S) : Hendrik Middeljans, Jannes Veurink and Johannes A. Juijn It is certified that error appears in the above-identified patent and that said Letters Patent is hereby corrected as shown below:

Column 3,
Line 28, "yam" should be -- yarn --.

Signed and Sealed this

Fourth Day of March, 2003

JAMES E. ROGAN
*Director of the United States Patent and Trademark Office*